US010012478B2

(12) United States Patent
Moran et al.

(10) Patent No.: US 10,012,478 B2
(45) Date of Patent: Jul. 3, 2018

(54) ARMOUR

(71) Applicant: NP Aerospace Limited, Coventry (GB)

(72) Inventors: Anthony Moran, Conventry (GB); Christopher Davies, Kenilworth (GB)

(73) Assignee: NP Aerospace Limited, Coventry (GB)

( * ) Notice: Subject to any disclaimer, the term of this patent is extended or adjusted under 35 U.S.C. 154(b) by 599 days.

(21) Appl. No.: 14/416,256

(22) PCT Filed: Jul. 19, 2013

(86) PCT No.: PCT/GB2013/051940

§ 371 (c)(1),
(2) Date: Jan. 21, 2015

(87) PCT Pub. No.: WO2014/016573

PCT Pub. Date: Jan. 30, 2014

(65) Prior Publication Data

US 2015/0184979 A1 Jul. 2, 2015

(30) Foreign Application Priority Data

Jul. 27, 2012 (GB) ..... 1213559.6

(51) Int. Cl.
*F41H 1/02* (2006.01)
*F41H 5/04* (2006.01)

(52) U.S. Cl.
CPC ..... *F41H 1/02* (2013.01); *F41H 5/0428* (2013.01)

(58) Field of Classification Search
CPC .... F41H 5/0414; F41H 5/0421; F41H 5/0428; F41H 5/0435
See application file for complete search history.

(56) References Cited

U.S. PATENT DOCUMENTS

| | | | | |
|---|---|---|---|---|
| 4,757,742 | A | 7/1988 | Mazelsky | |
| 4,923,728 | A | 5/1990 | Snedeker | |
| 5,317,950 | A | 6/1994 | Binon et al. | |
| 5,456,156 | A | 10/1995 | Semple | |
| 5,738,925 | A * | 4/1998 | Chaput | B32B 3/10 2/2.5 |
| 5,918,309 | A | 7/1999 | Bachner | |
| 6,009,789 | A * | 1/2000 | Lyons | F41H 5/0435 2/2.5 |
| 6,911,247 | B2 | 6/2005 | Howland | |
| 8,006,605 | B2 | 8/2011 | Tunis et al. | |
| 2003/0139108 | A1 | 7/2003 | Klintworth et al. | |

(Continued)

FOREIGN PATENT DOCUMENTS

| | | |
|---|---|---|
| CA | 2515868 C | 2/2006 |
| EP | 1878993 A2 | 1/2008 |

(Continued)

OTHER PUBLICATIONS

Canada Patent Application No. 2878321, Office Action (and examination search report) dated Oct. 5, 2015.

(Continued)

*Primary Examiner* — Stephen Johnson
(74) *Attorney, Agent, or Firm* — Kilpatrick Townsend & Stockton LLP; Dean W. Russell

(57) ABSTRACT

Armor comprises one or more ceramic plates differentially reinforced by reinforcement applied to a face of the plate to separate regions of low reinforcement by regions of higher reinforcement.

16 Claims, 6 Drawing Sheets

(56) References Cited

U.S. PATENT DOCUMENTS

| | | | | |
|---|---|---|---|---|
| 2007/0028758 | A1* | 2/2007 | Melin | F41H 5/04 89/36.02 |
| 2009/0324966 | A1 | 12/2009 | Benitsch et al. | |
| 2010/0154621 | A1* | 6/2010 | Nilakantan | D03D 1/0052 89/36.02 |
| 2011/0079133 | A1 | 4/2011 | Shkatov et al. | |
| 2012/0174745 | A1* | 7/2012 | Mann | F41H 5/0485 89/36.02 |
| 2013/0319214 | A1* | 12/2013 | Kopan | F41H 5/0478 89/36.02 |

FOREIGN PATENT DOCUMENTS

| | | | |
|---|---|---|---|
| EP | 2072943 | A1 | 6/2009 |
| GB | 2377006 | A | 12/2002 |
| GB | 2471702 | B | 5/2013 |
| GB | 2504497 | | 7/2014 |
| JP | 2000186899 | A | 7/2000 |
| RU | 2091693 | C1 | 9/1997 |
| WO | 2007055736 | A2 | 5/2007 |
| WO | WO 2008/054867 | * | 5/2008 |
| WO | 2009056287 | A1 | 5/2009 |

OTHER PUBLICATIONS

Canada Patent Application No. 2878321, Office Action (and examination search report) dated Sep. 21, 2016.

Europe Patent Application No. 13742689.6, Office Action dated Jun. 10, 2016.

Europe Patent Application No. 13742689.6, Office Action dated Feb. 28, 2017.

International Patent Application No. PCT/GB2013/051940, International Search Report and Written Opinion dated Oct. 16, 2013.

M40J Technical Data Sheet CFA-014, 2012, Toray Carbon Fibers America , Inc., Santa Ana, California, United States of America, 2 pages.

Umeco MTM28 28 Series Prepegs Data Sheet, Umeco Structural Materials (Derby) Ltd., Derbyshire, United Kingdom, 2012, 6 pages.

Solar Control Window Film Material Safety Data Sheet, 2001, Bekaert Speciality Films, LLC, San Diego, California, United States of America, 3 pages.

Great Britain Patent Application No. 1213559.6 (now U.S. Pat. No. 2,504,497), Combined Search and Examination Report dated Jul. 19, 2012, 1 page.

Europe Patent Application No. 13742689.6, Letter and Amendment dated Jan. 5, 2014, 6 pages.

* cited by examiner

ARMOUR

CROSS-REFERENCE TO RELATED APPLICATIONS

This application is the U.S. national phase entry of International Patent Application No. PCT/GB2013/051940, entitled "ARMOUR," filed Jul. 19, 2013, which application claims the benefit of United Kingdom Patent Application No. 1213559.6, entitled "ARMOUR," filed Jul. 27, 2012, the entire disclosures of both of which are hereby incorporated herein by reference.

FIELD OF THE INVENTION

This invention relates to armour comprising ceramic plates, and is particularly, although not exclusively, related to body armour.

BACKGROUND OF THE INVENTION

Ceramic materials have been used in armour from at least the 1950's. However, a major disadvantage of ceramic materials is that they tend to be brittle, limiting their ability to withstand multiple hits. A first bullet impact can crack the ceramic, resulting in a loss of protection against a second impact.

One attempt to overcome this problem is to use separate tiles rather than a single plate, so limiting damage to a single tile [e.g. U.S. Pat. No. 8,006,605]. This approach has the problem that the joins between the tiles represent points of weakness and securely mounting the tiles to form a unitary body can be complex.

A related proposal has been to use segmented plates so that damage is limited to individual segments of the plate [e.g. GB2377006] however this too has the problem that the joins between segments represent points of weakness.

The traditional method of increasing multi hit capability is to increase the thickness of the ceramic strike face or increase the number of layers in the composite backing or both. This increases weight and bulk of a given armour system.

A proposal to limit the area of damage and to reduce weight is to use ceramic plates comprising a series of holes in one or both faces [e.g. GB2471702]. The holes allegedly delimit the crack propagation of one hit, providing better multi-hit tolerance than a plate without holes. However, the holes themselves may provide points of weakness, since the plate is thinner under the holes than in the body of the plate. Resistance to multiple hits is academic if the first hit penetrates the armour.

Conventionally, ceramic body armour comprises not just the ceramic plate but also features such as anti-spall layers, energy absorbing backings and materials to wrap the ceramic plate and other components together [e.g. US2003/0139108].

It has been proposed to use carbon fibre reinforced plastics as front and/or back supporting layers to a ceramic plate [US2009/0324966].

SUMMARY OF THE INVENTION

The inventors have found that it is possible to improve multi-hit capability to a ceramic plate by providing differential reinforcement across a face of the plate to separate regions of low reinforcement by regions of higher reinforcement.

Accordingly, the present invention provides armour comprising one or more ceramic plates differentially reinforced across a face of the plate to separate regions of low reinforcement by regions of higher reinforcement.

Further features of the invention are set out in the claims and are illustrated by way of example in the following description and with reference to the drawings in which:—

DETAILED DESCRIPTION

Figure 1:
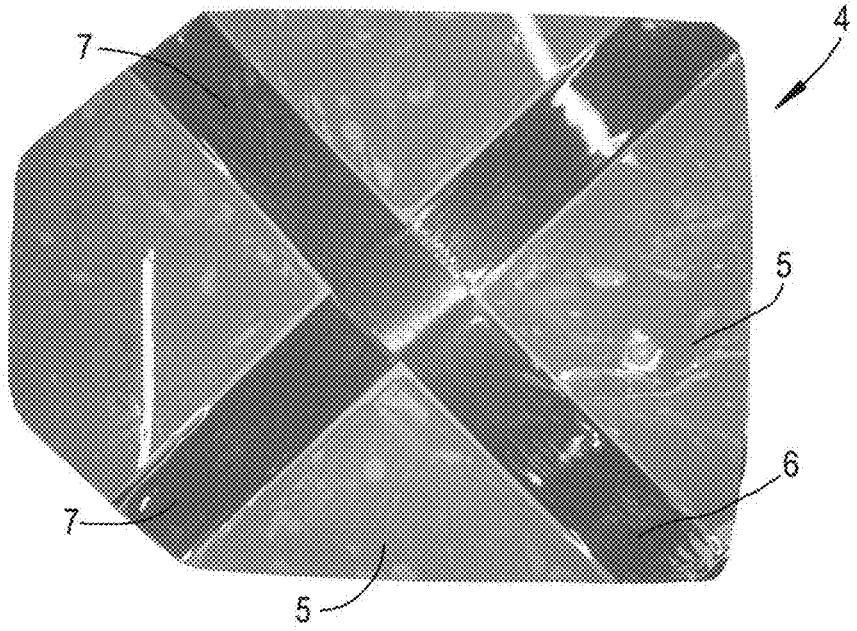
FIG. 1 is a photograph of a body armour plate.

The following describes ceramic body armour. It will be evident that the invention is not limited to body armour and may be applied to ceramic armour generally.

In the invention a ceramic armour plate 4 (see FIGS. 1 and 2) is reinforced differentially across a face of the plate 4 to separate regions 5 of low reinforcement by regions 6 of higher reinforcement.

The ceramic armour plate may be any ceramic as used for armour, for example silicon carbide, boron carbide, alumina, and composite ceramics. The invention is not limited to any specific ceramic but preferred are ceramics which are monolithic and/or ceramics which are dense [for example of greater than 95%, preferably greater than 99% theoretical density].

One or more of the regions of low reinforcement may have an area more than 1 $mm^2$; more than 10 $mm^2$; or more than 100 $mm^2$.

The regions of higher reinforcement may be of a width sufficient to separate the regions of low reinforcement by more than 1 mm; more than 5 mm; more than 10 mm; or more than 20 mm.

The regions of higher reinforcement may be regions to which fibre reinforcement is adhered, although non-fibrous reinforcement is contemplated, for example structural adhesives, resins, polymers, metals [e.g. brazed or deposited metals].

The regions of low reinforcement may be regions to which the fibre reinforcement is not adhered. Alternatively the regions of low reinforcement may be regions where fewer fibres are adhered than in the regions of higher reinforcement.

The fibre reinforcement may be applied as crossing strips 7 of fibre reinforcement.

The fibre reinforcement may be applied as a grid of crossing strips 7 of fibre reinforcement.

The fibre reinforcement may comprise fibres in a polymer matrix. Carbon fibres may be used, as may glass fibres, aramid fibres, high density polyethylene fibres, polyoxazole fibres, metal fibres, or any other fibre used for ballistic protection or structural reinforcement, however this list is not exhaustive and other fibres providing reinforcement may be used. The reinforcement may comprise a unidirectional assembly of fibres or may be woven or otherwise interlaced.

Suitable polymeric matrix materials may include epoxy resins, acrylic resins, or any other resin used in adhesive composites. However, this list is not exhaustive and other polymeric matrix materials may be used.

The fibre reinforcement may be provided in the form of a loose weave textile.

The differential reinforcement may be provided on the front face, rear face, or both faces of the ceramic plate.

Fibre reinforcement may be provided on one face and wrap round the edge of the ceramic plate to at least in part extend across the other face.

Further variants will be evident to the person skilled in the art. The following examples show the effect of the invention.

EXAMPLES

A series of ceramic body armour plates were made all having the same generic armour construction comprising from the attack face:—

- A polymer (polyethylene terephthalate polyester film [ARMORCOAT™ FROM Bekaert Specialty films LLC of San Diego) outer layer
- A ceramic (7 mm thick sintered silicon carbide) tile
- An adhesive (1 mm) layer (Arbokol 2150 from Adshead Ratcliffe & Co Ltd)
- A composite backing of comprising a resin impregnated Ultra High molecular Weight Polyethylene (Dyneema™ HB80 from DSM).

with the plate being wrapped in a fabric to protect the ceramic/composite assembly.

The outer layer may comprise other films [e.g. polycarbonate] or impregnated textile materials and serves to limit spall and to provide some additional resistance to cracking.

Adhesives that are typically used include epoxy, cyanoacrylate, polysulphide, polyurethane adhesives. However, this list is not exhaustive and other adhesives sufficient to provide good adherence to the ceramic plate and the backing may be used.

Composite backings typically include one or more of carbon fibres, glass fibres, aramid fibres, high density polyethylene fibres, polyoxazole fibres, metal fibres, or metal plates. However, this list is not exhaustive and other backings may be used. Trade names for commercially available ballistic backings include SpectraShield™ and GoldShield™ [Honeywell] and Dyneema™ [DSM].

To show the effect of the invention, a plate comprised of just the above-mentioned integers was compared with two plates 4 in which a carbon fibre composite was applied in a non-uniform manner to the front face of the ceramic (i.e. under the polymer outer layer). Each of the assembled plates had a weight below 2.5 kg.

The carbon fibre composite used (designated MTM28-1/M40J(12K)-165-46% RW) was a pre-preg ["pre-preg" is a term of art meaning a composite of fibres pre-impregnated with a material that is cured after forming into shape] obtained from Umeco Structural Materials (Derby) Limited and comprised their MTM28-1 resin system with unidirectionally disposed M40J(12K) fibres [Toray Carbon Fibers America, Inc.].

The pre-preg weight areal density was 165 $g \cdot m^{-2}$ with a 46% resin loading.

The pre-preg was separated into strips of appropriate width for use.

In the first embodiment [FIG. 1] a large cross of the pre-preg unidirectional carbon fibre tape 7 was applied across the surface of the ceramic 4 and wrapped around the ceramic (approximately 50 mm on the rear surface) The pre-preg was applied in a double thickness of tapes of 50 mm width.

Figure 2:
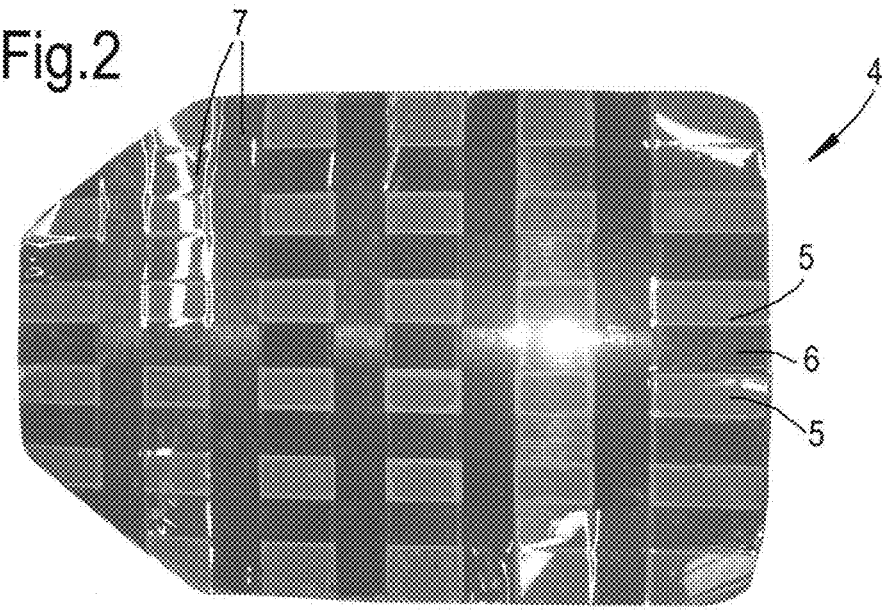
FIG. 2 is a photograph of second type of body armour plate.

In the second embodiment [FIG. 2] a grid pattern was used of the same tape 7 but with narrower width 20 mm and applied in a single thickness. The grid pattern divides the surface of the ceramic 4 into of cells 5 having a tape free centre, most of which are bounded on all sides by the tape 7, with the tape free centre of some cells extending to the edge of the plate. It would be possible by applying tape along the face edge of the ceramic [or indeed along the edge of the ceramic] to have all of the cells bounded on all sides by the tape.

The total mass of pre-preg used was identical in each case, [about 25 g].

The ceramic with applied pre-preg, polymer coating, adhesive and composite backing were pressed and autoclaved to bond all together and cure the pre-preg.

Following manufacture, the plates of FIGS. 1 and 2 were tested with a conventional plate having no applied fibre reinforcement. Testing comprised firing 7.62 mm rounds at the plates to see the effect.

Figure 5:
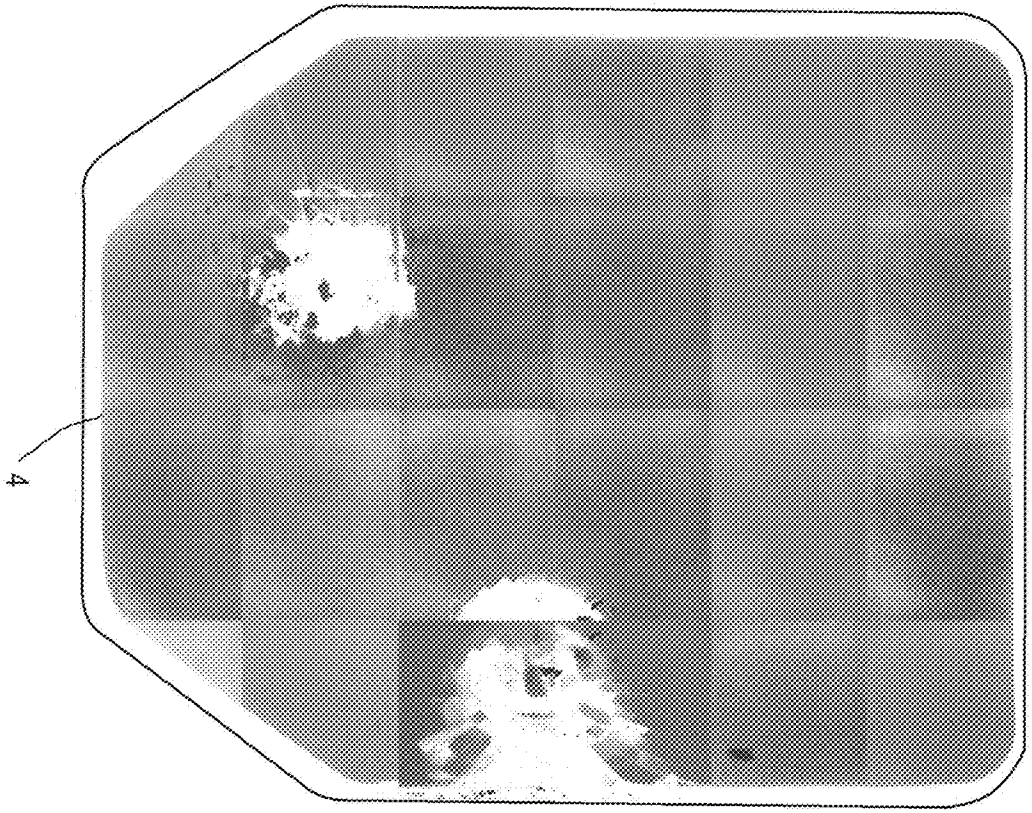
FIG. 5 is an assembly of X-rays of a comparative armour plate following multiple hits.

FIG. 5 shows an X-ray of an unreinforced plate following two hits from a 7.62 mm round. Large cracks are formed across the surfaces (and internally) through the ceramic element of the plates causing the plate to have a poor shot ⅔ performance. Generally for this plate thickness the second round penetrated through plates a majority of times. The X-ray images show large cracks running through the plate after 2 rounds had been fired into it. Large cracks run to all edges of the plate and multiple cracks between the two impact points can be seen. Although increasing the thickness of the plate would improve multi-hit capability this would also increase the mass of the plate.

Figure 3:
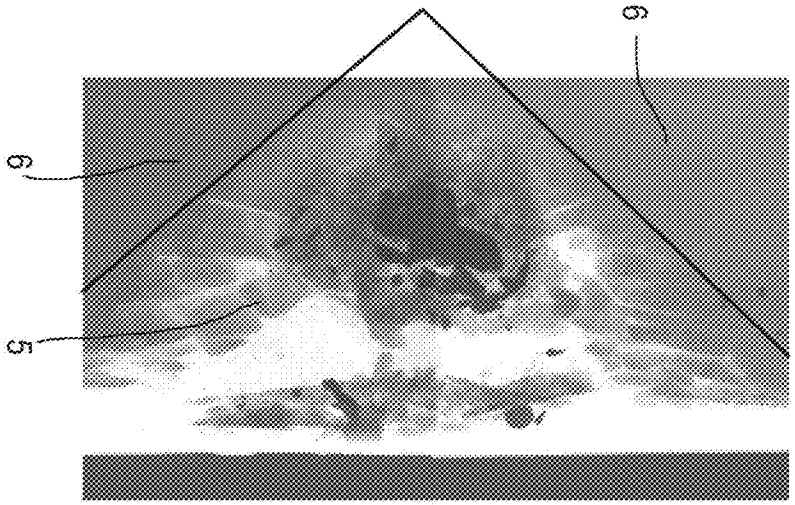
FIG. 3 is an X-ray of a hit on the armour of FIG. 1.
Figure 4:
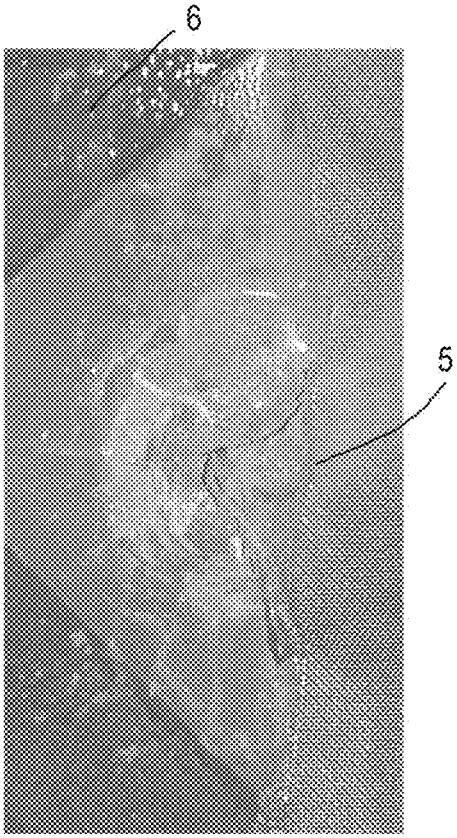
FIG. 4 is a photograph of the same hit as shown in FIG. 3.

The X-ray image of FIG. 3 and photograph of FIG. 4 show the crack mitigating effect of the wrap in the embodiment of FIG. 1. The cracks stop at the edge of the tape or shortly after passing into the region below the tape. This restriction of crack propagation leaves large areas of the ceramic untouched allowing multiple rounds to be stopped within a plate.

Figure 6:
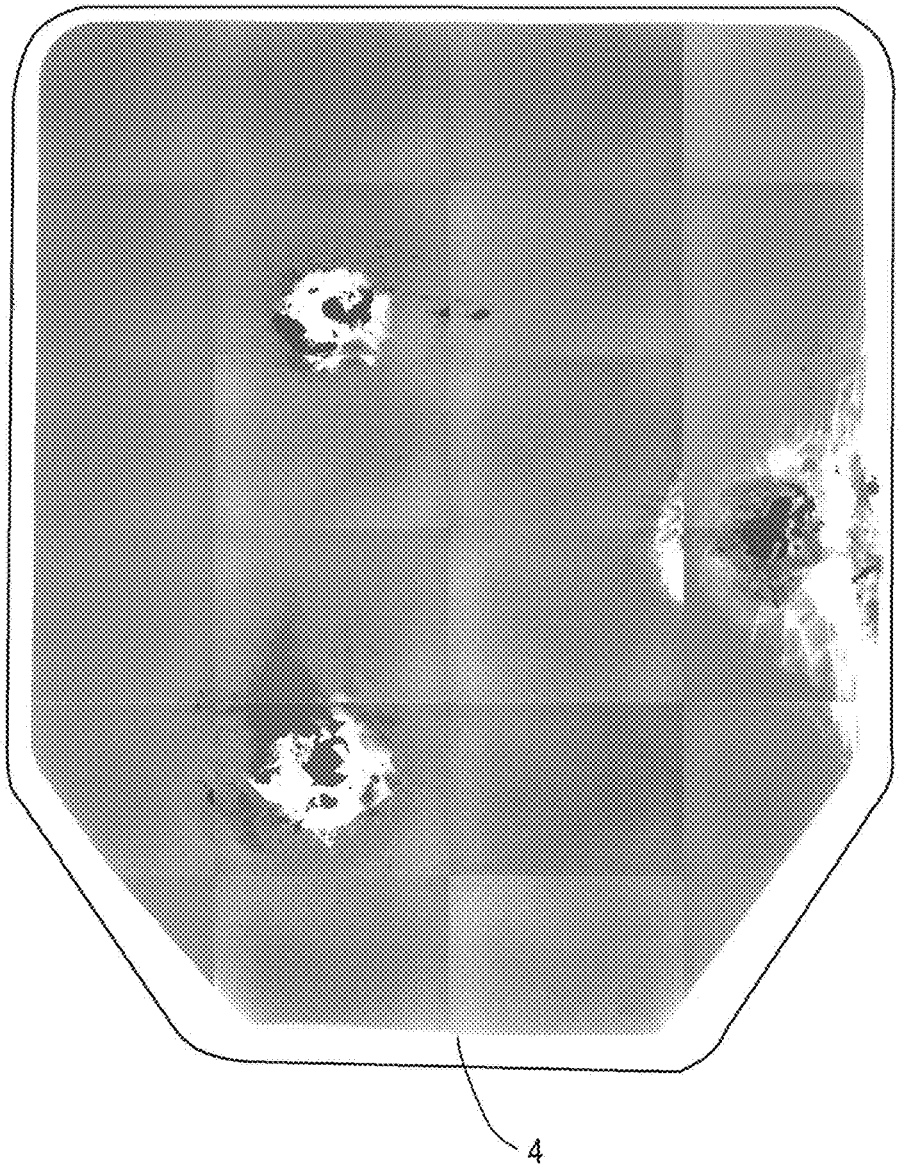
FIG. 6 is an assembly of X-rays of the armour of FIG. 1 following multiple hits.
Figure 7:
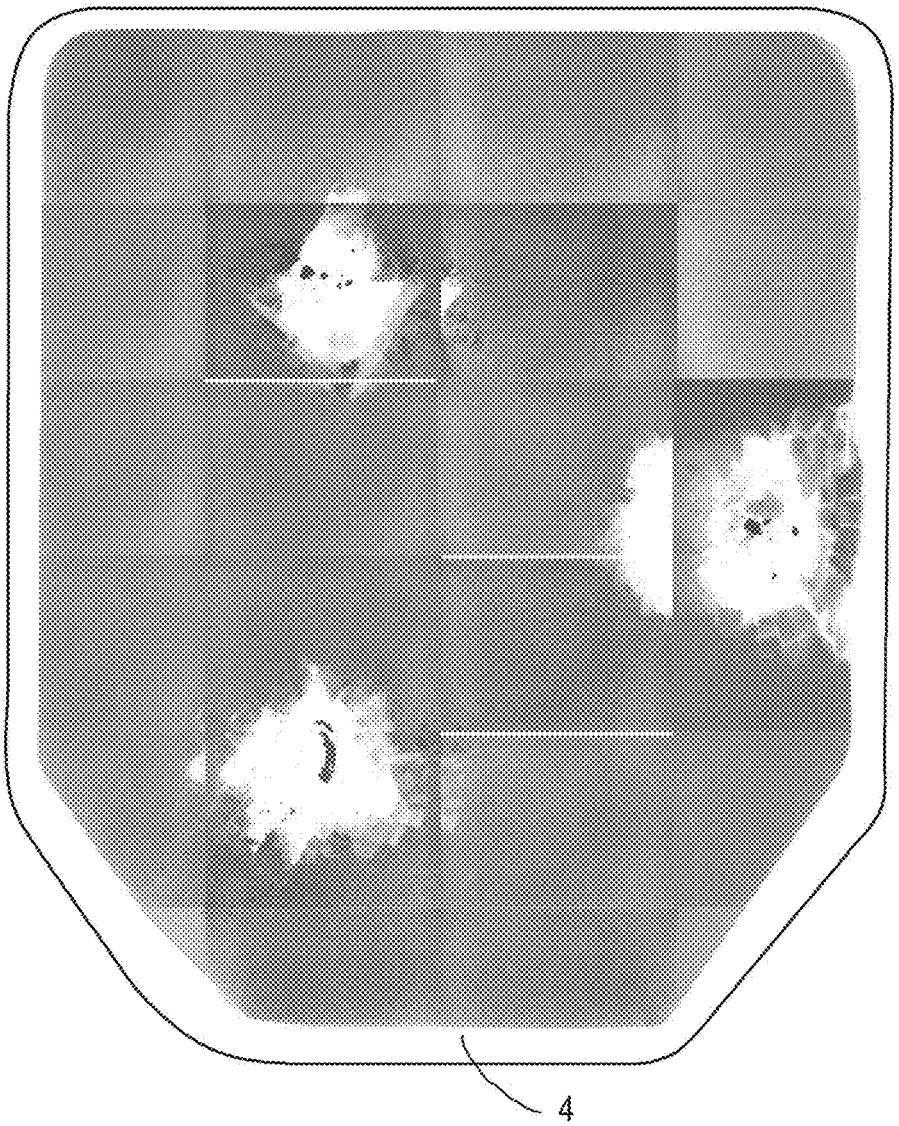
FIG. 7 is an assembly of X-rays of the armour of FIG. 2 following multiple hits; and, FIGS. 8 and 9 respectively are front and rear photographs of the plate of FIG. 7.

FIGS. 6 and 7 shows X-rays of plates showing three hits from a 7.62 mm round.

Figure 8:
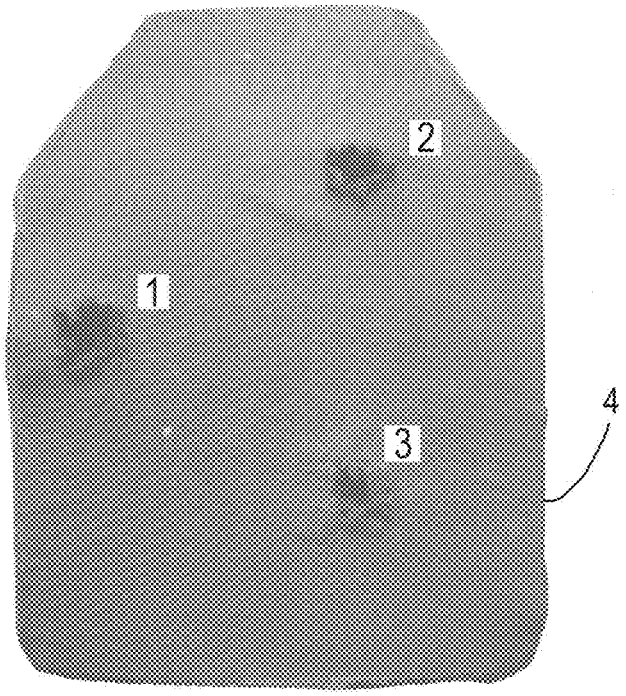
Figure 9:
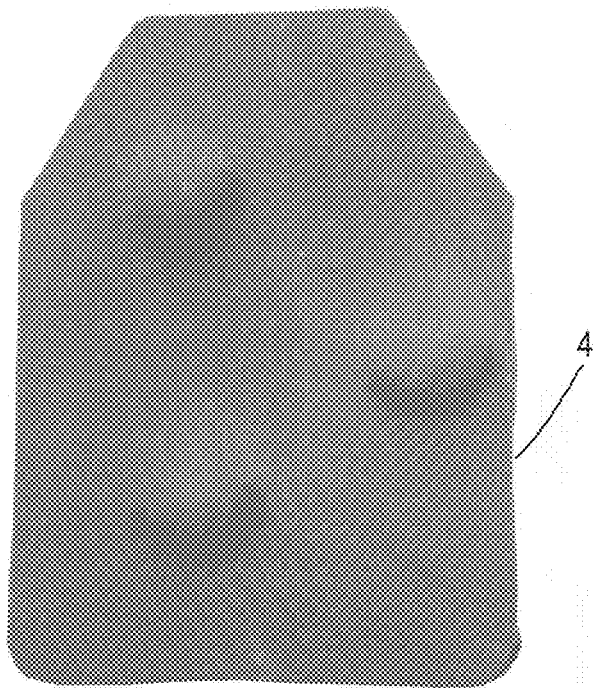

FIGS. 8 and 9 show front and rear views respectively of an armour plate as in FIG. 2 after receiving three 7.62 mm rounds [in the order 1, 2, 3 shown in FIG. 8] showing that the hacking bulged, but the armour stopped all three rounds.

Samples have been demonstrated capable of receiving four spaced rounds without penetration.

The above examples illustrate the effect of the invention which is to provide, with little additional weight, improved multi-hit capability to a ceramic armour plate.

The invention claimed is:

1. Armour comprising a ceramic plate differentially reinforced by reinforcement applied to a face of the plate to separate two or more regions of low reinforcement by regions of higher reinforcement, in which the regions of higher reinforcement are of a width sufficient to separate the regions of low reinforcement by at least 1 mm and in which one or more of the regions of low reinforcement each has an area more than 100 $mm^2$.

2. Armour as claimed in claim 1, in which the regions of higher reinforcement are regions of the face of the ceramic plate to which fibre reinforcement is adhered.

3. Armour as claimed in claim 2, in which the regions of low reinforcement are regions of the face of the ceramic plate to which the fibre reinforcement is not adhered.

4. Armour as claimed in claim 2, in which the fibre reinforcement of the regions of higher reinforcement is applied as crossing strips of fibre reinforcement.

5. Armour as claimed in claim 4, in which the fibre reinforcement is applied as a grid of crossing strips of fibre reinforcement.

6. Armour as claimed in claim 1, in which the regions of higher reinforcement are of a width sufficient to separate the regions of low reinforcement by more than 5 mm.

7. Armour as claimed in claim 6, in which the regions of higher reinforcement are of a width sufficient to separate the regions of low reinforcement by more than 10 mm.

8. Armour as claimed claim 7, in which the regions of higher reinforcement are of a width sufficient to separate the regions of low reinforcement by more than 20 mm.

9. Armour as claimed in claim 1, in which the reinforcement comprises fibres in a polymer matrix.

10. Armour as claimed in claim 1, in which the reinforcement comprises carbon fibres.

11. Armour as claimed in claim 1, in which the reinforcement comprises a unidirectional assembly of fibres.

12. Armour as claimed in claim 1, in which the ceramic plate comprises a front face and a rear face, and the differential reinforcement is provided on the front face of the ceramic plate.

13. Armour as claimed in claim 12, comprising a backing layer applied to the rear face of the ceramic plate.

14. Armour as claimed in claim 1, in which differential reinforcement is provided on the rear face of the ceramic plate.

15. Armour as claimed in claim 1, in which fibre reinforcement is be provided on one face of the ceramic plate and wraps round the edge of the ceramic plate to at least in part extend across the other face.

16. Armour comprising more than one ceramic plate, at least one ceramic plate of the armour being differentially reinforced by reinforcement applied to a face of the ceramic plate to separate two or more regions of low reinforcement by regions of higher reinforcement, in which the regions of higher reinforcement are of a width sufficient to separate the regions of low reinforcement by at least 1 mm and in which one or more of the regions of low reinforcement each has an area more than 100 $mm^2$.

* * * * *